United States Patent [19]

Carafeno

[11] Patent Number: 4,521,015

[45] Date of Patent: Jun. 4, 1985

[54] TOY BASEBALL BAT DEVICE

[76] Inventor: Joseph A. Carafeno, 15 Miller Rd., Northford, Conn. 06472

[21] Appl. No.: 563,134

[22] Filed: Dec. 19, 1983

[51] Int. Cl.[3] ..... A63B 69/40

[52] U.S. Cl. ..... 273/26 B; 124/16; 124/36

[58] Field of Search ..... 273/26 B, 29 R, 129 V, 273/129 W; 124/16, 34, 36

[56] References Cited

U.S. PATENT DOCUMENTS

| | | | |
|---|---|---|---|
| 202,301 | 4/1878 | Taltavull | 124/36 X |
| 1,590,006 | 7/1926 | Eliason | 124/16 |
| 2,279,766 | 4/1942 | Truesdell | 124/16 |
| 2,626,154 | 1/1953 | Lowry | 273/129 V |
| 3,111,314 | 2/1966 | Topper | 273/26 B |
| 3,115,342 | 11/1963 | Webster | 273/26 B |
| 3,120,387 | 12/1963 | Weinstein | 273/26 B |
| 3,236,521 | 2/1964 | Knott | 273/26 B |
| 3,819,179 | 6/1974 | Ambler, Jr. et al. | 273/26 B |
| 4,271,813 | 6/1981 | Rowe | 124/34 X |

*Primary Examiner*—Richard C. Pinkham
*Assistant Examiner*—T. Brown
*Attorney, Agent, or Firm*—Prutzman, Kalb, Chilton & Alix

[57] ABSTRACT

A toy baseball bat comprising an elongated member having an exterior configuration in the form of a baseball bat. The hitting end portion forms an interior chamber for housing a plurality of ball elements and has a radially disposed ejection aperture adapted to allow the ejection of a ball radially outwardly from the interior chamber. A ball support element within the interior of the chamber supports an individual ball at a predetermined position in alignment with the ejection aperture. A guide channel guides balls within the chamber to the ball support element. A striker element is pivotally mounted within the chamber for pivotal movement between first and second positions so as to strike a ball mounted on the support element as the striker element pivots towards the first position to drive the ball radially outwardly through the ejection aperture. A torsion spring propells the striker element towards the first position and normally biases the striker element towards the first position, and a trigger assembly is operationally connected to the striker element for normally withdrawing the striker element towards the second position againt the biasing force of the torsion spring and abruptly releasing the striker element.

12 Claims, 1 Drawing Figure

TOY BASEBALL BAT DEVICE

BACKGROUND AND SUMMARY OF THE INVENTION

This invention relates to a toy baseball bat and more particularly to a ball-ejecting toy baseball bat.

In the past, it has been common in batting practice for a batter to grasp a ball, throw it into the air a short distance, and then quickly grasp the bat with both hands and assume a batting stance to hit the ball. Upon hitting the ball, the batter selects another ball off the ground or from a container on the ground and repeats the batting action.

Prior toy batting devices have attempted to eliminate the inconvenience of picking up the balls from the ground prior to each batting swing by storing the balls within a hollow chamber in the bat for sequential removal prior to each swing. Such toy bats are utilized not only for solo batting practice but for competitive games based upon fast-action, repetitious batting skills.

The prior toy bats however are inconvenient and cumbersome to use and cost prohibitive to manufacture. For example, the toy bat shown in U.S. Pat. No. 3,111,314 to E. Topper utilizes a complicated spring and latching cam mechanism for ejection of the balls and requires a separating cocking operation between each batting swing. Such an ejection mechanism is cost prohibitive to manufacture in the competitive toy market and the cocking operation is disruptive to fast-action, repetitious batting.

Other toy bats such as those disclosed in U.S. Pat. No. 3,236,521 to P. Knott and U.S. Pat. No. 3,120,387 to S. Weinstein utilize pneumatic-type ejection mechanism for ejecting the balls axially from the hitting end of the toy bat. Such ejection mechanisms are costly and less durable while axial ejection is somewhat inconvenient for fast-action, repetitious batting.

In a ball-ejecting toy baseball bat, it is desirable to attain expeditious sequential ejection of the balls without inefficient and inconvenient cocking operations. Additionally, it is also desirable that the bat ejection position be expedient to fast-action, repetitive batting with a proper batting stance and that the toy bat be economical to manufacture.

Accordingly, it is an object of the present invention to provide a ball-ejecting toy baseball bat that permits sequential ball ejection without a disruptive cocking operation.

It is another object of the invention to provide a ball-ejecting toy bat which is economical to manufacture with a limited number of operational parts and which is durable in use.

Another object of the invention is to provide a ball-ejection toy bat which is easy and efficient to use and conducive to fast-action, repetitious batting.

It has been found that the foregoing and related objects can be obtained in a toy baseball bat device which includes an elongated member having an exterior configuration in the form of a baseball bat of cylindrical cross section with a smaller diameter handle end portion and an oppositely disposed larger diameter hitting end portion. The hitting end portion forms an interior chamber for housing a plurality of balls and has a radially disposed ejection aperture adapted to allow ejection of a ball radially outwardly from the interior chamber. A guide directs the balls to a ball support element for supporting an individual ball at a predetermined position in alignment with the ejection aperture. A striker element is pivotally mounted within the chamber for pivotal movement between first and second positions so as to strike a ball mounted on the support element as the striker element pivots towards the first position to drive the ball radially outwardly through the ejection aperture. A torsion spring is connected to the striker element for normally biasing the striker element towards the first position to propel the striker element towards the first position to strike the ball mounted on the support element. A trigger assembly is operationally connected to the striker element for momentarily withdrawing the striker element towards the second position against the biasing force of the torsion spring and for abruptly releasing the striker element whereby the biasing force of the torsion spring pivots the striker element towards the first position to drive a ball radially outwardly through the ejection aperture.

BRIEF DESCRIPTION OF THE DRAWING

The drawing is a partial cross-sectional view of a toy baseball bat device in accordance with the present invention.

DESCRIPTION OF THE PREFERRED EMBODIMENT

Figure 1:
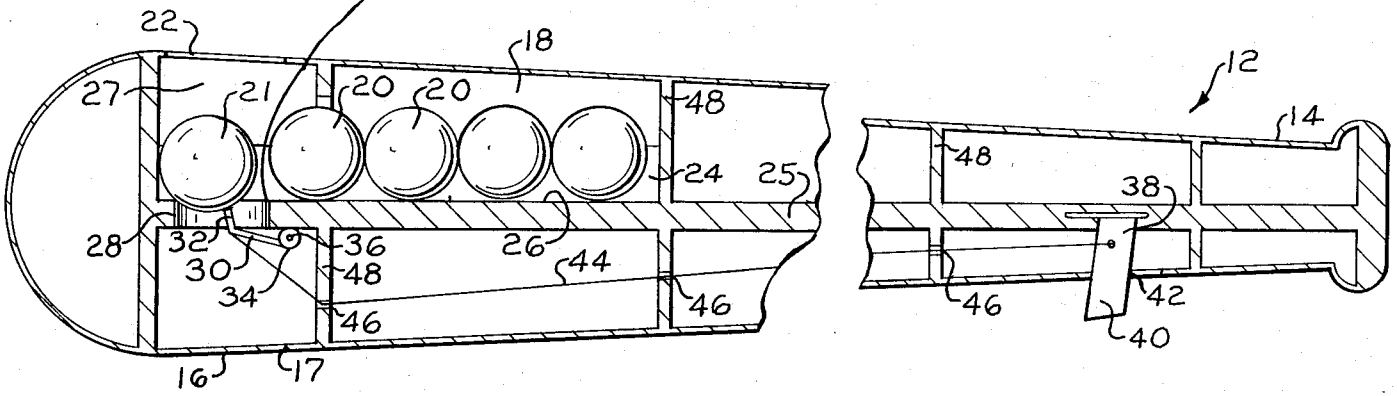

Referring the the drawing, the toy baseball bat device of the present invention comprises an elongated bat member generally designated by the numeral 12 and having an exterior configuration in the general form of a conventional baseball bat of cylindrical cross section with a smaller diameter handle end portion 14 and and oppositely disposed larger diameter hitting end portion 16. The annular wall 17 of the bat member 12 forms an interior chamber 18 in the hitting end 16 for housing a plurality of balls 20. The wall 17 contains a radially disposed ejection aperture 22 to permit the ejection of a ball radially outwardly from the interior chamber 18. In the illustrated embodiment, the ejection aperture 22 is generally oblong in shape having a minor lateral axis slightly greater than the diameter of the ball and a major longitudinal axis 1.5 times greater than the diameter of the ball with the major axis being axially aligned with the bat member 12.

An axially extending guide channel 24 within the interior chamber 18 is formed by opposing said walls 27 and a bottom support surface 26 with the channel 24 being dimensioned and configured to maintain the ball elements in a line. An axially extending frame brace 25 forms the bottom support surface 26 of the guide channel 24 to vertically support the balls 20. A support recess or aperture 28 is positioned at the outwardly disposed end of the guide channel 24 for supporting a single ball 21 in alignment with ejection aperture 22. The upper portion of the aperture 28 forms a retaining recess of predetermined size for maintaining the single ball 21 in fixed predetermined position in alignment with the ejection aperture 22 and the lower portion of the aperture exposes the ball 21 to impact by a striker element 30.

The striker element 30 is pivotally mounted to the underside of the brace 25 for pivotal movement between a first or upper position (as shown in the drawing) and a second or lower position (counterclockwise from the first position). The striker element 30 has a striker head 32 for striking engagement with the ball 21 and is mounted within the chamber 18 so as to strike the ball 21 as the striker element pivots toward the first position thereby driving the ball radially outwardly through the ejection aperture 22.

A torsion spring 34 is mounted to the striker element and biases the striker element toward the upper position for propelling the striker element 30 towards the upper position to strike the ball 21. The striker element 30 pivots about a pivot axis 36 and the torsion spring 34 is mounted about the pivot axis 36. In the normal at-rest position, the torsion spring 34 maintains the striker element 30 at the first position wherein the striker element 30 extends into the support aperture 28 to prevent a ball from being seated within the support recess. In an alternate embodiment, the striker element extends through the support aperture to retain the balls within the guide channel during nonbatting movement.

A trigger element 38 is pivotally mounted to the handle end portion 14 of the elongated element 12 for pivotal movement between first and second positions. The trigger element 38 has a lower end 40 extending generally radially outwardly through a slot 42 in the wall 17 for pivotal movement axially toward and away from the hitting end portion 16. A wire element 44 is connected at one end to the trigger element 38 and at the other end to the striker element 30. The wire 44 extends through a plurality of guide sleeves 46 in the transverse support braces 48 of the elongated member 12 to directly connect the trigger element 38 to the striker element 30.

The wire 44 is taut so that manual movement of the lower end 40 of the trigger element 38 in a direction away from the hitting end 16 operates to withdraw the striker element 30 in a counterclockwise direction away from the upper position against the biasing force of the torsion spring 34. Abruptly releasing the lower end 40 of the trigger element 38 causes the biasing force of the torsion spring to propel the striker element towards the upper position and thereby impact the ball 21 to drive it radially outwardly through the ejection aperture 22. Since the wire element 44 is taut between the striker element and the trigger element 38, the torsion spring 34 thereby biases the lower end 40 of the trigger element 38 towards the hitting end 16 of the elongated member 12 to yieldably maintain the trigger in the position shown in the drawing.

In operation, the balls are loaded into the guide channel 24 through the ejection aperture 22. The bat member 12 is gripped at the handle end 14 and held horizontally with the trigger element 38 extending downwardly and the ejection aperture 22 disposed upwardly. The handle end portion 14 is raised slightly with respect to the hitting end portion 16 so as to cause the outer-most ball to roll to the support aperture 28. The upper edge of the support aperture 28 is beveled inwardly to facilitate mounting the ball within the support aperture 28. The trigger element 38 is "squeezed", i.e., pivoted rearwardly away from the hitting end 16, to withdraw the striker head 32 from the support aperture 28 to allow the ball 21 to seat within the aperture 28 thereby securely positioning the ball 21 at a predetermined position in alignment with the ejection aperture 22.

The handle end portion 14 is tipped slightly downwardly to maintain the bat element 12 at a more or less horizontal orientation. In this position, the remaining balls 20 will roll towards the handle end portion 14 due to the slight incline of the guide chamber 24 so as not to present an obstruction to the ejection of the mounted ball 21.

The trigger element 38 is abruptly released from the "squeezed" position whereby the biasing force of the torsion spring 34 propels the striker element towards its upper position causing it to impact the ball 21 ejecting it radially outwardly through the ejection aperture 22. The torsion force of the torsion spring 34 is of predetermined amount to eject the ball a predetermined desirable height above the horizontally extended bat. As the ball is ejected, the batter easily and quickly moves the bat from the horizontal ejection position to assume a correct batting stance so as to be able to take a correct swing at the ejected ball.

After contact with the ejected ball, the bat is immediately returned to the horizontal position and another ball is quickly loaded for ejection. As can be appreciated, the ejection operation can be accomplished in a very short time after impact with the preceding ball since the batter need only squeeze the trigger to mount a ball within the support aperture 28, level the bat to its horizontal orientation and abruptly release the trigger to release the ball. Accordingly, a plurality of balls can be conveniently and quickly batted away without significant movement of the hands (for a cocking operation or otherwise) and without sacrificing a proper batting stance. Thus, fast-action, repetitious batting is attained.

As can be seen, the toy bat device of the present invention may be economically constructed utilizing a limited number of operational parts. The striker element, torsion spring and trigger assembly may be efficiently mounted to the interior frame of the bat device. The annular wall 17 may be constructed of plastic or other suitable material and affixed about the frame in sections to form a rigid secure bat device with a smooth outer surface simulating a conventional basball bat. With the exception of the ejection aperture 22 and the trigger slot 42, the outer surface of the bat presents a continuous smooth surface.

Accordingly, a ball-ejecting toy baseball bat has been provided which permits sequential ball ejection without a disruptive cocking operation, and which is easy and efficient to use and conducive to fast-action, repetitious batting. Moreover, the toy bat is durable in use and economical to manufacture.

As will be apparent to persons skilled in the art, various modifications and adaptations of the structure above described will become readily apparent without departure from the spirit and scope of the invention, the scope of which is defined in the appended claims.

I claim:

1. A toy baseball bat device comprising:

an elongated member having an exterior configuration in the form of a baseball bat of cylindrical cross section having a smaller diameter handle end portion and an oppositely disposed larger diameter hitting end portion, said hitting end portion forming an interior chamber for housing a plurality of balls and having a radially disposed ejection aperture adapted to allow the ejection of a ball radially outwardly from said interior chamber, a ball support means within said interior chamber for supporting an individual ball at a predetermined position in alignment with said ejection aperture to permit the ball to be impacted and driven radially outwardly through said ejection aperture, means for guiding the balls within said chamber to said ball support means, a striker element pivotally mounted within said chamber for pivotal movement between first and second positions so as to strike a ball mounted on said support means at said predetermined position as said striker element pivots towards said first position to drive the ball radially outwardly through said ejection aperture, said second position being spaced from a ball supported on said support means, a torsion spring means for propelling said striker element towards said first position to strike a ball mounted on said support means, said torsion spring means being connected to said striker element and normally biasing said striker element towards said first position, and trigger means operationally connected to said striker element for momentarily withdrawing said striker element towards said second position into spaced disposition from a ball supported on said support means against the biasing force of said torsion spring means and adapted for abrupt release of said striker element whereby the biasing force of the torsion spring means pivots said striker element toward said first position to impact a ball supported by said support means at said predetermined position and drive said ball radially outwardly through said ejection aperture.

2. The device of claim 1 wherein said trigger means comprises, an elongated trigger element pivotally mounted to said handle end portion of said elongated member for movement between first and second positions, said trigger element having a lower end extending generally radially outwardly from said handle end portion for pivotal movement axially toward and away from said hitting end position, and wire means for connecting said trigger element to said striker element so that manual movement of said lower end of said trigger element away from said hitting end withdraws said striker element towards said second position.

3. The device of claim 2 wherein said wire means directly interconnects said striker element and said trigger element so that said torsion spring means biases said lower end of said trigger element towards said hitting end.

4. The device of claim 2 wherein said wire means comprises a single wire element connected at one end to said trigger element and at the other end to said striker element.

5. The device of claim 1 wherein said torsion spring means comprises a torsion spring mounted about said striker element to bias said striker element about its pivot axis towards said first position.

6. The device of claim 1 wherein said ball support means comprises a support member having a retaining recess of predetermined size for maintaining a ball in fixed position in alignment with said ejection aperture and an access opening adjoining said recess for said striker element to strike a ball mounted within said recess as said striker element pivots towards said first position.

7. The device of claim 6 wherein said retaining recess and said access opening are formed by a support aperture extending through said support member, said support aperture being dimensioned and configured to expose the lower portion of a ball mounted therein for contact with said striker element.

8. The device of claim 7 wherein said striker element extends into said support aperture at said first position.

9. The device of claim 6 wherein said guiding means comprises a channel formed within said interior chamber for holding a plurality of balls in a line, said channel extending to said retaining recess so that upon tipping the handle end of said elongated end above said hitting end, a ball would roll along said channel to said recess, said striker element extending into said recess in said first position to block a ball from being supported in said recess in a fixed position in alignment with said ejection aperture and to allow a ball to be supported in said recess in a fixed position in alignment with said ejection aperture upon withdrawal of said striker element from said recess by said trigger means.

10. The device of claim 9 wherein said striker element extends through said recess in said first position to retain balls within said channel during movement of the bat.

11. The device of claim 1 wherein said elongated member has an outer surface having said ejection aperture at said hitting end and a trigger slot at said handle end with the remainder of said outer surface being a continuous, smooth surface simulating a conventional baseball bat.

12. A toy baseball bat device comprising, an elongated member having an exterior configuration in the form of a baseball bat of cylindrical cross section having a smaller diameter handle end portion and an oppositely disposed larger diameter hitting end portion, said hitting end portion forming an interior chamber for housing a plurality of balls and having a radially disposed ejection aperture adapted to allow the ejection of a ball radially outwardly from said interior chamber, a ball support means within said interior chamber for supporting an individual ball at a predetermined position in alignment with said ejection aperture, means for guiding the balls within said chamber to said ball support means, a striker element pivotally mounted within said chamber for pivotal movement between first and second positions so as to strike a ball mounted on said support means at said predetermined position as said striker element pivots towards said first position to drive the ball radially outwardly through said ejection aperture, said ball support means comprising a support member having a retaining recess of predetermined size for maintaining a ball in fixed position in alignment with said ejection aperture and an access opening adjoining said recess for said striker element to strike a ball mounted within said recess as said striker element pivots towards said first position, said recess having a beveled inwardly disposed circumferential edge to guide a ball into said recess, a torsion spring means for propelling said striker element towards said first position to strike a ball mounted on said support means, said torsion spring means being connected to said striker element and normally biasing said striker element towards said first position, and trigger means operationally connected to said striker element for momentarily withdrawing said striker element towards said second position against the biasing force of said torsion spring means and adapted for abrupt release of said striker element whereby the biasing force of the torsion spring means pivots said striker element toward said first position to drive a ball radially outwardly through said ejection aperture, said guiding means comprising a channel formed within said interior chamber for holding a plurality of balls in a line, said channel extending to said retaining recess so that upon tipping the handle end of said elongated member above said hitting end, a ball would roll along said channel to said recess, said striker element extending into said recess in said first position to block a ball from being supported in said recess in a fixed position in alignment with said ejection aperture and to allow a ball to be supported in said recess in a fixed position in alignment with said ejection aperture upon withdrawal of said striker element from said recess by said trigger means.

* * * * *